US005218986A

United States Patent [19]

Farwell

[11] Patent Number: 5,218,986

[45] Date of Patent: Jun. 15, 1993

[54] PNEUMATICALLY PRESSURIZED WATER PUMPING APPARATUS

[76] Inventor: Duane C. Farwell, 2740 Highway BB, Cottage Grove, Wis. 53527

[21] Appl. No.: 867,348

[22] Filed: Apr. 13, 1992

[51] Int. Cl.[5] ..... F04B 41/06

[52] U.S. Cl. ..... 137/14; 137/209; 417/6; 417/120

[58] Field of Search ..... 137/209, 211, 206, 1, 137/14; 417/6, 1, 2, 65, 118, 120; 222/401, 399

[56] References Cited

U.S. PATENT DOCUMENTS

| | | | |
|---|---|---|---|
| 1,979,407 | 11/1934 | Pike | 137/209 |
| 2,085,274 | 6/1937 | Rutt | 222/399 X |
| 2,318,066 | 5/1943 | Dodd | 137/209 X |
| 2,687,841 | 8/1954 | Churchman | 137/204 X |
| 2,976,950 | 3/1961 | Smith | 137/209 X |
| 2,988,002 | 6/1961 | Dodd | 137/211 |
| 3,130,741 | 4/1964 | Vetere | 137/204 X |
| 4,560,089 | 12/1985 | McMillin | 222/399 X |

*Primary Examiner*—Alan Cohan
*Attorney, Agent, or Firm*—Keith Schoff

[57] ABSTRACT

Water pumping apparatus is described for use with wells in which on-off cycling in pump operation is minimized by providing an air compressor and compressed air holding tank feeding an pressure regulating valve connected to discharge into a water holding tank, thereby enabling constant pneumatic pressure to be maintained in the water tank without regard to water level in the tank so that each cycling of the water pump will completely fill the water tank from nominally empty condition to nominally full condition.

3 Claims, 2 Drawing Sheets

PNEUMATICALLY PRESSURIZED WATER PUMPING APPARATUS

FIELD OF THE INVENTION

Water for improved property use in rural areas is drawn from wells by the use of electric motor driven pumps feeding into a closed water tank reservoir. Air trapped in the tank above the water exerts pneumatic pressure to cause pressurized running water flow when a tap or faucet is opened.

PRIOR ART

In conventionally installed rural water systems, only about ten percent of tank capacity is drained before the pneumatic pressure of trapped air is reduced sufficiently so that automatic pressure controls activate the water pump motor to refill the tank with water. The result is that the frequency of motor and pump actuation is about ten times what would be necessary if the entire tank contents were drained before refilling. Both motor life and electrical usage are greatly affected by number of occurrences of motor starting so that short cycling operation of a water pump is wasteful of energy and equipment life.

SUMMARY OF THE INVENTION

Utilizing a supplemental installation in a water pumping system of an air compressor and compressed air holding tank together with necessary controls and valves enables the applicant to provide a water pumping system in which a water holding tank reservoir can be drained from nominally full condition to nominally empty condition between each activation of a water pump, thereby not only increasing energy efficiency and equipment life, but also providing constant pressure delivery of water at a tap comparable to municipal water systems rather than fluctuating pressure delivery characteristic of conventional rural systems.

Air from a compressed air holding tank is fed to a water tank reservoir through a gas pressure regulating valve to provide constant pneumatic pressure in the tank during draw down of water in the reservoir through the delivery piping. When the tank reservoir is nominally empty, the water pump is automatically activated and the tank is refilled with water, with over pressurizing the trapped air resulting in a relief valve being forced open. Maximum energy efficiency can be obtained by recycling the air released from the water tank reservoir to the intake of the air compressor, although this is not a necessary feature of the invention.

DESCRIPTION OF THE INVENTION

Figure 1:
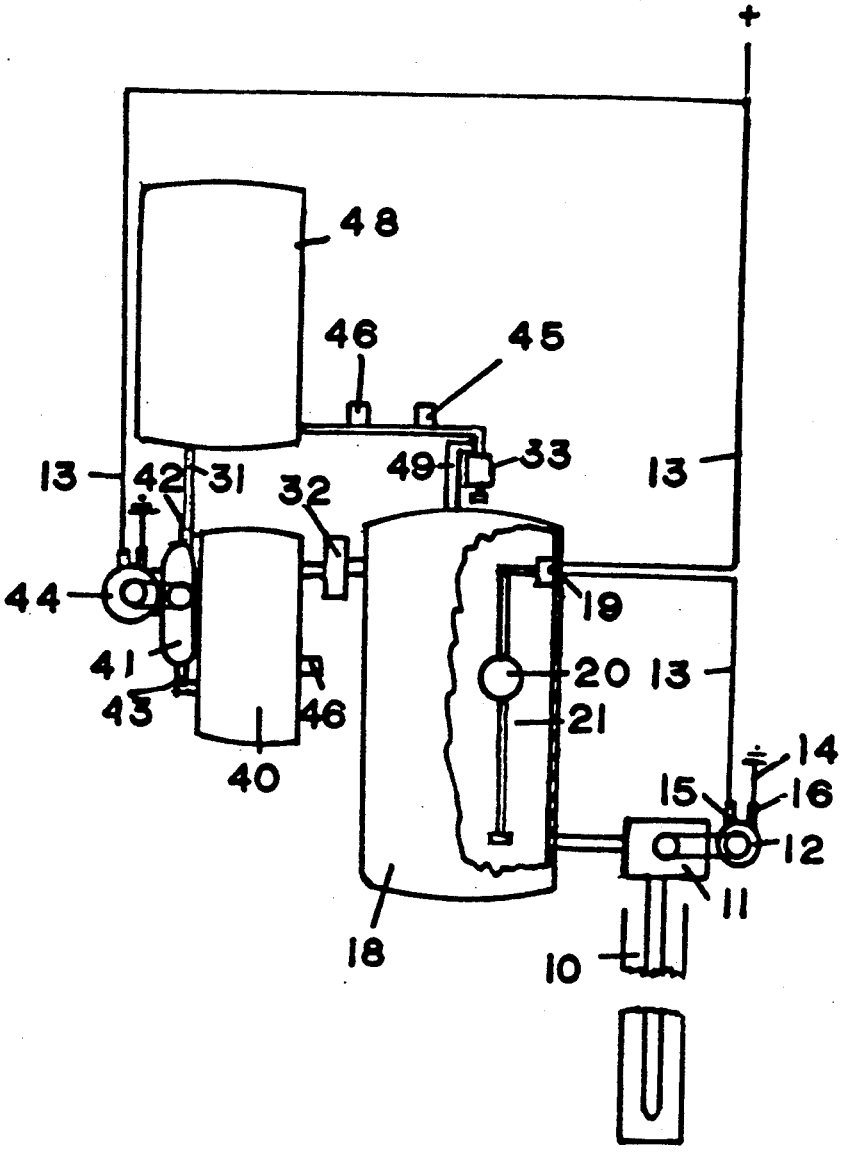
FIG. 1 is a schematic diagram of one embodiment of a water pumping apparatus of this invention.

In FIG. 1 water well 10 is shown provided with water pump 11 driven by electric motor 12. Electric service lines 13, 14 are operably connected to associated motor switch 19 and motor 11 terminals 15, 16. Switch 19 is biased on and off by movement of vertical rod mounted float 20 wherein float 20 is preferably configured annularly to slide along fixed rod 21. At an operational level of float 20 near the bottom of tank reservoir 18, switch 19 is biased by the weight of float 20 to actuate motor 12, and at an operational level near the top of reservoir 18, switch 19 is biased by buoyant force of float 20 to deactuate motor 12. Rod 21 is fixed to switch 19 biasable mechanism such as a toggle switch arm. Any operable type of switch may be used such as, for example Speedaire model 1P504 manufactured under the mark registered to W. W. Grainger, Inc. 5959 W. Howard Street, Chicago. Ill.

A suitable switch 19 will automatically response to the elevational level of water in closed water tank reservoir 18, whether the switch is float controlled, or of magnetic reed type, or any other operable type suitable to actuate drive motor 12 and pump 11 to fill reservoir 18 through pipe 17 from well 10, or other water source, when the water level in reservoir 18 drops to the lower operational level of switch 19, and to deactuate motor 12 and pump 11 when the water level within reservoir 18 has risen to the upper operational level of switch 19.

Preferably, the proportion of reservoir 18 volume between the operational levels of switch 19 is at least ninety percent of the total volume of reservoir 18, and may closely approach one hundred percent of the capacity of reservoir 18. Other than the placement of switch operational levels, the apparatus above described is conventional and comprises no part of this invention.

Non-self-relieving gas pressure regulating valve 32, such as Speedaire model 5Z254, for example, and pressure relief valve 33 are both communicated to the top extremity portion of reservoir 18. A preferred embodiment of a fully mechanical form of valve 33 for use in the invention is shown in detail in FIG. 2. An electric solenoid operated valve of adequate sensitivity may also be used for valve 33. The two valves respectively provide inlet and outlet ports for air within water reservoir 18.

Air compressor 41, comprising suction port 42 and discharge port 43, drive motor 44 equipped with pressure sensitive electrical switch controls, and compressed air tank 40 may be provided as a package assembly, such as, for example, Speedaire model 3Z420.

Conduit 31, shown as part of a closed loop assembly comprising air accumulator tank 48, check valve 45, and safety valve 46 which communicates the outlet port of pressure relief valve 33 with suction port 42 of air compressor 41, provides a means for maximizing energy efficient operation of the pumping system, but such assembly is not require for use in the invention. If provided, however, check valve 45 provides for inflow of air at ambient atmospheric pressure into the system, and may be, for example, Speedaire model 5X783. Safety valves 46 are provided in case of equipment malfunction to protect the apparatus from over pressurization to the point of structural failure, such valves customarily being required by various safety codes to open at either 125 p.s.i.a. or 150 p.s.i.a. Preferably, the combined volumes f the elements comprising the closed loop passage between valve 33 and suction portion 42 will equal the volume displaced by water filing water reservoir 18 between actuation operation of switch 19 and deactuation operation.

In operation, water pump 11 is actuated when water is drawn down in water reservoir 18 to the lower operational level of switch 19, actuating motor 12 on pump 11, and is deactuated when water fills the reservoir to the upper operational level of switch 19, for deactuating the motor.

Pressurized air within reservoir 18 will be further compressed by water rising in the tank and at a pre-set pressure, e.g. 50 p.s.i.g., will cause valve 33 to pen to release air from reservoir 18 into air accumulator tank 48. Periodically, air compressor 41 will be actuated to maintain air pressure in tank 40 above a pre-set level, the frequency of such actuation being dependent on the relative size of tank 40 to the displaced volume of water reservoir 18 and the pressure level to which air is compressed in tank 40. With fixing of these variables, it is possible to determine an optimum capacity for tank 48 to minimize energy usage for operation of compressor 41.

The described operation of the disclosed apparatus serves to maintain nominally constant water pressure in a water distribution system and to minimize frequency of water pump operation. It is apparent, however, that similar results may be obtained if compressed air storage tank 40 is eliminated with discharge port 43 of air compressor 41 being connected to exhaust directly to pressure regulating valve 32, with the disadvantage that drive motor 44 of air compressor 41 will cycle more frequently, so that such an arrangement is not preferred.

Figure 2:
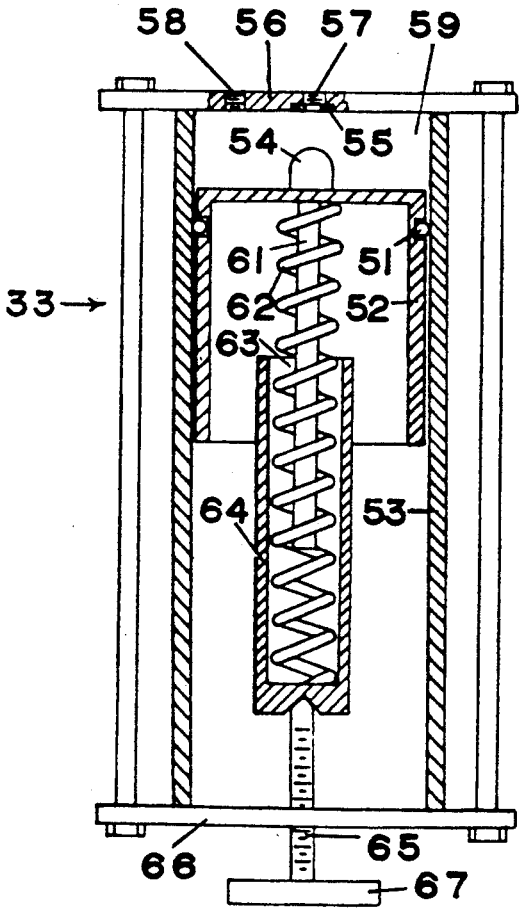
FIG. 2 is a partial sectional elevation of valve 33 of FIG. 1.

In FIG. 2, valve 33 is shown comprising piston 52 fitted with O-ring 51 in contact with the polished internal surface of cylinder wall 53 in operable manner to seal against air leakage past the piston. Sensitivity of valve response should be such that one ounce of force will move piston 52 within the cylinder in non-spring loaded, non-pressurized state. Snub portion 54 projects from the face of piston 52 to close against annular resilient seat 55 which is fixed in cylinder head 56. Vent 57 in cylinder head 56 communicates through seat 55 to pressure chamber 59, and in the apparatus shown in FIG. 1, exhaust air from valve 33 to air accumulator tank 48. Step portion 61 of piston 52 axially extends through helical compression spring 62. Spring 62 is seated in cup 63 of sleeve portion 64 of adjusting screw 65, with screw 65 being operably received through cylinder base 66 and provided with knob 67. Manually turning knob 67 increases or decreases compression loading of piston 52 by spring 62 so that the air pressure in chamber 59 necessary to unseat snub portion 54 of piston 52 from seating contact with seat 55 can be varied. For use in the apparatus of FIG. 1, a setting of spring compression to provide valve 33 opening pressure approximately 5 p.s.i.g. above the setting of vale 32 opening pressure is desirable, for example, valve 32 may be set to open at 45 p.s.i.g. and valve 33 may be set to pen at 50 p.s.i.g. depending on the height to which water is to be delivered and the tap pressure desired. Both valve 32 and valve 33 should be non-self-relieving in operation for use in the apparatus of FIG. 1. Response sensitivity of valve 33 is greater than that of known pressure relief valves and is required for maintaining relatively constant pressure in water reservoir 18 of the apparatus of FIG. 1. Opening 58 is an inlet port in valve 33 which in the apparatus of FIG. 1 connects to water reservoir 18 by pipe 49.

The top of snub portion 54 of piston 52 is hemispherically configured so that in moving toward and away from contact with seat 55, the cross-sectional area of an air flow passage through seat 55 is varied in a continuous controlled manner approximating a linear response relationship to the position of snub portion 54. The configuration provides for smooth, non-chattering opening of vent 57 without auxiliary damping means and near-constant pressure condition in pressure chamber 59 rather than wide fluxuations of pressure of 10 p.s.i. or more characteristic or pressure relief valves of customary design.

Check valve 45 is provided to enable atmospheric air to enter the closing piping system shown in FIG. 1 to release air lost to dissolution in water from the quantity of air recirculated in the system. Pneumatic pressurization of water in water reservoir 18 to superatmospheric condition increases the solubility of air in water so that fresh air intake is required. Such means are not required, however, if air recirculation is not provided.

In a non-preferred embodiment of the invention, seat 55 may comprise metal rather than resilient material, and may be a surface of cylinder head 56 surrounding vent 57. Portion 54 of piston 52 may similarly in a non-preferred embodiment of the invention, be configured with a non-planar surface other than hemispherical, such as conical, and may make contact directly with cylinder head 56, however, a configuration is required to provide for gradual increase and decrease in size of the air passage opening to vent 57 by movement of piston 52 rather than an abrupt change from a fully open passage to a fully closed one by minimal increment in actuating pressure.

I claim:

1. In a water pumping apparatus embodying a water pump configuring with an inlet port and an outlet port, a water pump drive motor, a pneumatically pressurized, closed water tank reservoir, and automatic water tank reservoir water level maintenance switch controls for actuating and deactuating the water pump drive motor; an improvement comprising, a) an air compressor configured with a suction port and a discharge port, b) a drive motor for said air compressor, c) a closed compressed air storage tank communicated to said discharge port of said air compressor, d) automatic, air storage tank pressure sensing switch controls for actuating and deactuating said drive motor for said air compressor, e) a gas pressure regulating valve configurated with an inlet port and an outlet port, disposed with it inlet port communicating to said compressed air storage tank and its outlet port communicating to said water tank reservoir, f) a pressure relief valve configured with an inlet port and an outlet port, disposed with its inlet port communicating to an upper extremity portion of said water tank reservoir, g) means for activating said water level maintenance switch controls to actuate said water pump drive motor when the water level in said water tank reservoir is near the bottom of said tank reservoir, and to deactuate said switch controls when the water level is near the top of said reservoir wherein pneumatic pressure in said water tank reservoir is maintained nominally constant throughout variation in water determined by said water level maintenance switch position for deactuating the water pump, to nominally empty condition as determined by said water level maintenance switch position for actuating said water pump, thereby to minimize frequency of on-off cycling of the water pump drive motor during operational use of said water pumping apparatus.

2. The water pumping apparatus of claim 1 comprising a closed vessel communicating said outlet port of said pressure relief valve with said inlet port of said air compressor, said vessel being provided with a check valve for admitting ambient air into said vessel at near atmospheric pressure within said vessel.

3. A process for supplying superatomospherically pressurized water at substantially constant delivery pressure in distribution piping comprising the steps of a) providing power operation of a water pump wherein actuation and deactuation thereof is automatically performed by water level sensing switch control means disposed in a closed water holding tank for actuating said water pump when the water level in said tank is near the bottom of the tank and for deactuating said water pump when the water level in said tank is near the top of the tank.

b) providing power operation of an air compressor wherein actuation and deactuation thereof is automatically performed by air pressure sensing switch control means disposed in a closed compressed air holding vessel.

d) providing a gas pressure regulating valve disposed to receive higher pressure compresses air from said compressed air holding vessel, and to exhaust regulated lower pressure compressed air to said closed water holding tank, thereby to maintain substantially constant pneumatic pressurization of water in said water holding tank throughout variation of water level in said water holding tank between operational levels of said water level sensing switch controlling means.

* * * * *